United States Patent [19]

Machate et al.

[11] Patent Number: 4,685,733

[45] Date of Patent: Aug. 11, 1987

[54] CHAIR

[75] Inventors: Rainer Machate, Biebertal; Robert Vonhausen, Giessen, both of Fed. Rep. of Germany; Eckhard Hansen, St. Margrethen, Switzerland

[73] Assignee: Voko Franz Vogt & Co., Fed. Rep. of Germany

[21] Appl. No.: 865,325

[22] Filed: May 21, 1986

[30] Foreign Application Priority Data

May 23, 1985 [DE] Fed. Rep. of Germany ..... 3518567
Sep. 27, 1985 [DE] Fed. Rep. of Germany ..... 3534496

[51] Int. Cl.[4] ..... A47C 3/00

[52] U.S. Cl. ..... 297/284; 297/301; 297/353

[58] Field of Search ..... 297/301, 302, 284, 311, 297/353

[56] References Cited

U.S. PATENT DOCUMENTS

| | | | |
|---|---|---|---|
| 488,992 | 1/1893 | Forney | 297/284 X |
| 3,588,172 | 6/1971 | McGregor | 297/284 X |
| 4,380,352 | 4/1983 | Diffrient | 297/301 X |
| 4,560,199 | 12/1985 | Sapper | 297/301 X |

FOREIGN PATENT DOCUMENTS

| | | |
|---|---|---|
| 049310 | 4/1982 | European Pat. Off. . |
| 3116459 | 11/1982 | Fed. Rep. of Germany . |
| WO83/00610 | 3/1983 | PCT Int'l. Appl. . |

*Primary Examiner*—James T. McCall
*Attorney, Agent, or Firm*—Jones, Tullar & Cooper

[57] ABSTRACT

A chair having a seat member rotatably supported about a swivel point in the region of its front edge relative to a seat carrier. The chair also has a back member connected to at least one lever which is pivotally supported on the seat carrier. The lever is connected so that in the case of an inclination of the back member there simultaneously occurs in a predetermined relationship an inclination of the seat member so that the area of the seat back in the region of the user's lumbar vertebra is changed in such a way that the support is at an optimum during each inclined position of the seat back. A control member is hingedly connected at one end to the back member below the point of its engagement with the lever. The control member is hingedly connected to the seat carrier or to the seat at its other end in a first pivot axle spaced from a second pivot axle of the lever on the seat carrier. The lever and the control member are hingedly connected with one another by means of a connecting element, so that a relative movement between the lever and the control member in the coupling point or between the control member and its connecting point on the seat carrier or on the seat can occur.

19 Claims, 5 Drawing Figures

CHAIR

FIELD OF THE INVENTION

The invention relates to a chair having a seat member rotatably supported about a pivot point lying adjacent the front edge of the seat carrier of the chair, and further having a back member connected to one or several levers pivotally supported on the seat carrier and, at locations spaced from their pivot points, are further connected to the seat carrier or the seat in such a way that during an inclination of the back there occurs simultaneously, in a predetermined relationship, an inclination of the seat.

BACKGROUND OF THE INVENTION

A seat of the abovementioned type is known, for example from Swiss Pat. No. 529 537. The back of the seat is on the chair rotatably supported about a front swivel bearing, while the back member is connected swingably through a lever to the seat carrier. The connection between the back member, namely the lever of the back member, and the seat member occurs through a control member, so that during an inclination of the back member, the seat member is lowered a specific amount. A similar arrangement is known for Gebrauchsmuster No. 84 17 429. Here the difference lies only in the lever of the back member being rotatably connected directly with the seat member, while the control member is arranged between the lever and the seat carrier. Here too an inclination of the seat member is obtained with a specific back inclination.

A chair is known from German A No. 1 33 16 533, in which also upon a swivelling of the back member there occurs a seat back inclination. In this embodiment, the control, according to the Gebrauchsmuster No. 84 17 429, has been replaced with a sliding guide, which, on the one hand, determines the coupling of seat and back in a predetermined relationship and, on the other hand, effects the balance in view of the different fulcrum points of seat and lever of the back.

All of these known chairs have the disadvantage, that the support for the back in the lumbar vertebra area can be constructed at an optimum only for a very specific seat back inclination, while the support for a seat back inclination which is changed for this, be it with a steeper or with a flatter positioned seat back, is insufficient.

The basic purpose of the invention is to provide a chair of the abovementioned type so that the support of the lumbar vertebras in the region of the user's back by the seat back is changed with the change in the inclination of the back of the chair such that the support is optimal during each seat back inclination.

Thus in the inventively constructed chair, there is arranged a main control member extending parallel to the lever, to which the back member is secured and which engages at the same time the seat member. The lower end of the control member is hinged either to the seat carrier or to the seat member. The upper end of the control member is hinged to the lumbar vertebra area of the back of the chair. The lever which carries the back member and the control member are rotatably connected with one another, so that in the case of a change in the inclination of the back member, there occurs additionally a swivelling of a part of the back member in an opposite sense. As a result, during a large back inclination, the support in the lumbar vertebra area becomes greater, while the support is reduced accordingly during a steeper more upright back inclination, so that a suitable support is provided during each back inclination.

Since the lower hinged connection of the lever and also of the control member must lie spaced from one another, or otherwise a suitable change in the form of the back member cannot be obtained, and since the control member and lever are rotatably coupled with one another, the relative movement between the control member and the lever must be balanced in order to obtain a balance of the different fulcrum points. The balance of the relative movement can be obtained either through a connecting link guide, or through an intermediate, or additional, control member, either of which connects the lever and the main control member with one another, or in the alternative connects the main control member to the seat carrier. By selecting the hinge points for the main control member on the lever or the seat carrier and by selecting the length of the additional control member and as well as its hinged location on the seat carrier or by selecting the location of the connecting link guide between the two control members, the magnitude of the change of the form of the user's back in the lumbar vertebra region is determined.

In an advantageous embodiment of the invention, the additional control member, or in the alternative the connecting link guide, is arranged between the main control member and the lever to facilitate an adjustment of the chair to different body sizes by adjusting the length of the control member or, in the alternative, the inclination of the connecting link guide.

BRIEF DESCRIPTION OF THE DRAWINGS

One exemplary embodiment of the invention will be described in greater detail hereinbelow with reference to the drawings, in which.

DETAILED DESCRIPTION

Figure 1:
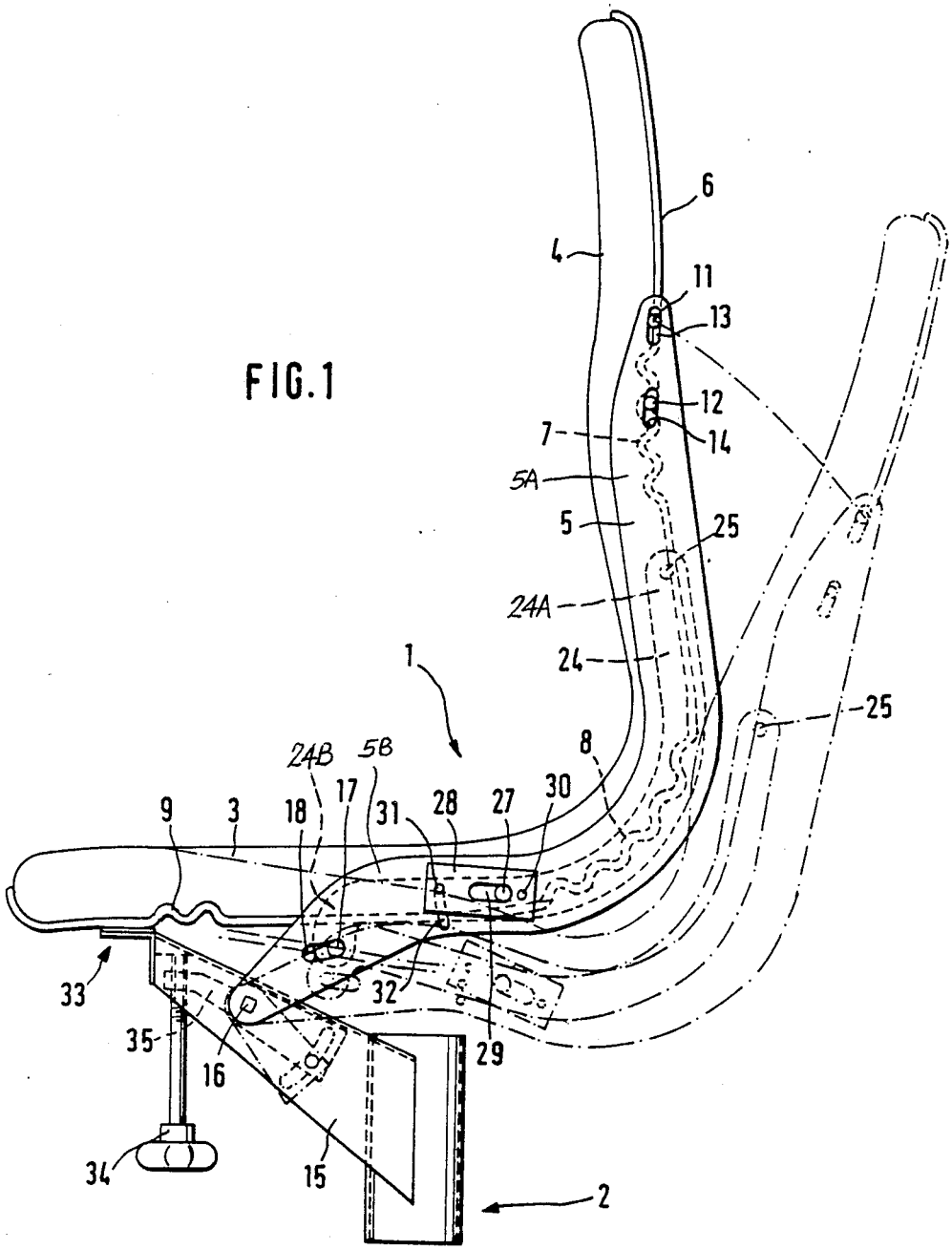
FIG. 1 is a side view of an exemplary embodiment of an inventive chair.
Figure 2:
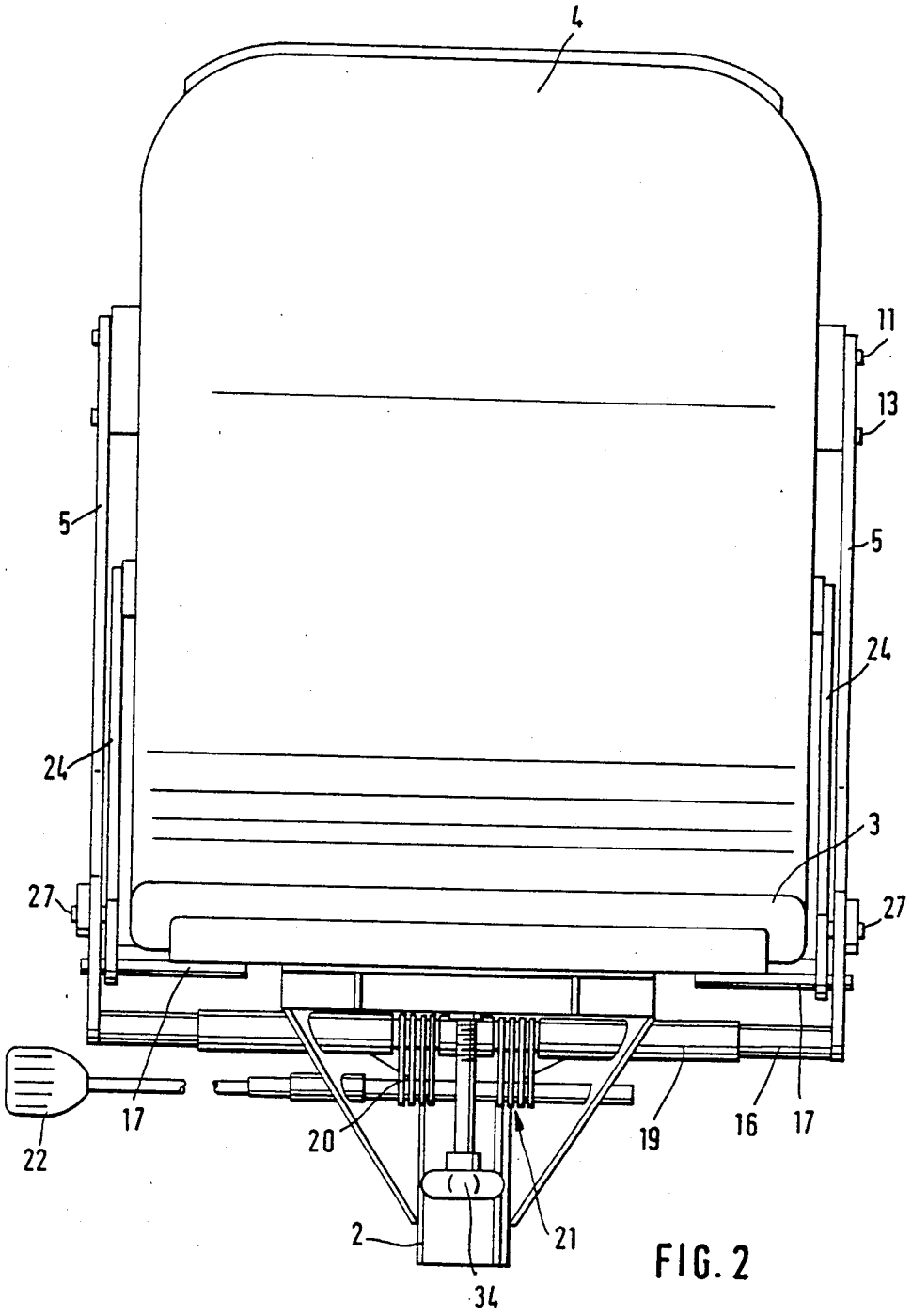
FIG. 2 is a front view of the chair shown in FIG. 1.
Figure 3:
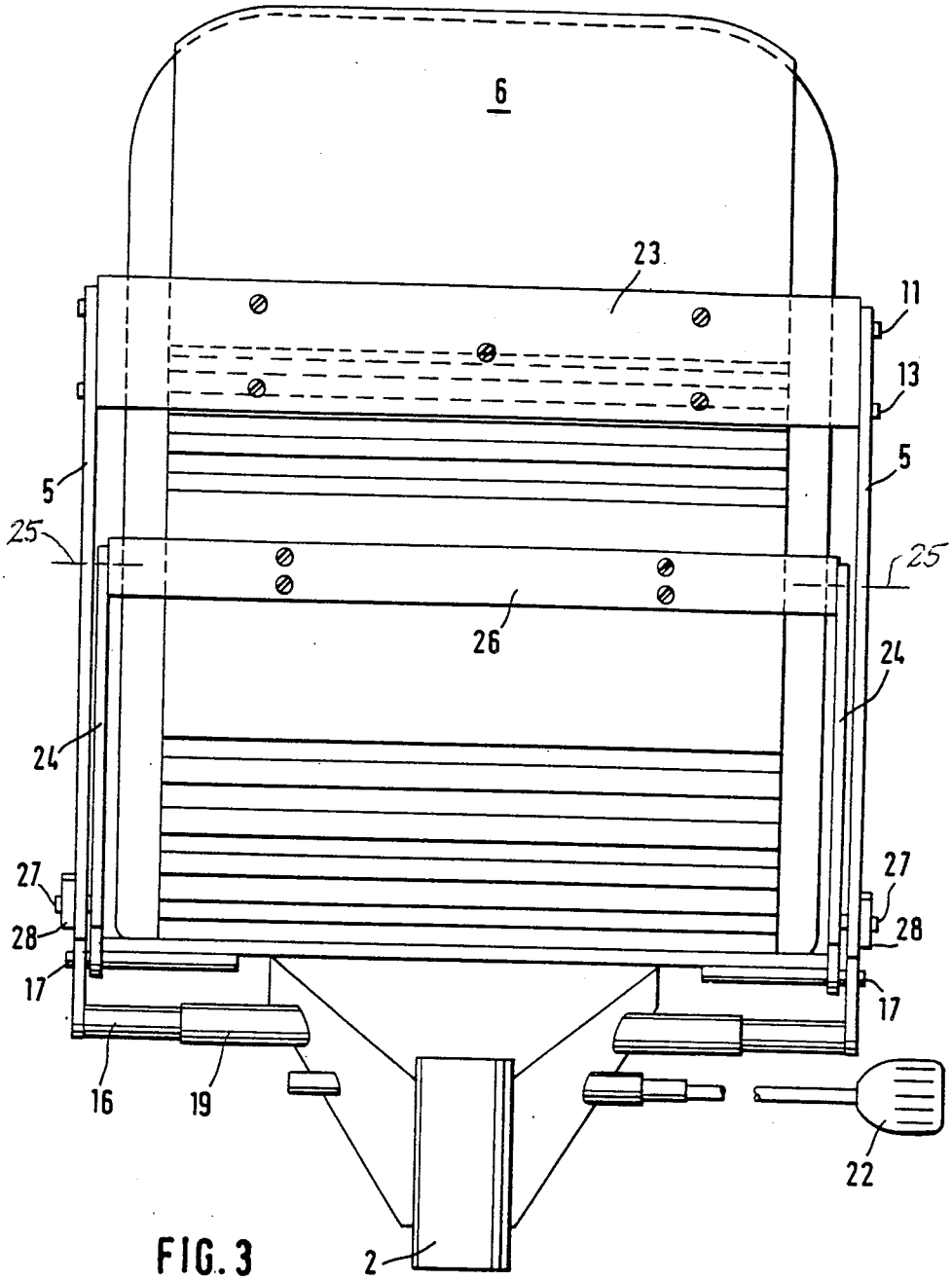
FIG. 3 is a rear view of the chair shown in FIGS. 1 and 2.

The chair 1 which is illustrated in FIGS. 1 to 3 has a seat carrier or pedestal 2, to which a seat member 3 is hingedly and swingably connected. In this exemplary embodiment, the seat member 3 is connected in one piece with an upright back member 4. An L-shaped seat shell 6 is provided which is either constructed flexibly throughout or has flexible areas 7, 8, 9. The seat member 3 is mounted to one leg of the seat shell 6 while the back member 4 is mounted to the other leg of the seat shell. An L-shaped lever 5 is secured to the back member 4, namely by means of two bolts 11, 12 received in elongated slots 13, 14 which are provided on the upright leg 5A the lever 5. Through this construction the back member 4 is held fixed against relative rotation with respect to the lever 5; however, movability of the back member 4 in direction of the longitudinal axis of the upright leg of the lever 5 is possible.

The other leg 5B of the lever 5 is pivotally supported on an arm 15 on the seat carrier 2 and for movement about an axis of rotation of an axle 16. A bolt 17 is secured to the seat member 3 and is received in a connecting link guide 18 provided on the lever 5. During a swivelling of the back member 4 backwardly, the lever 5 also pivots backwardly about its pivot axle 16 on the seat carrier 2 and carries along therewith the seat member 3 due to the bolt 17 received in the connecting link guide 18 and which is secured on the seat member 3. By selecting the distance of the bolt 17 from the axis of rotation 16, the degree of inclination of the seat member 3 relative to the inclination of the back member 4 can be adjusted. A ratio of 1:2 is here advantageously chosen. In the case of a seat back inclination of 2°, a seat back inclination of 1° occurs.

As can be seen in particular from FIG. 2, the axle 16 is rotatably supported in a hollow bushing type bearing 19. Disks 20 are fixedly arranged on the axle, which disks can be secured by means of a braking mechanism 21. The axle is constructed as a torsion rod and is held fixed against rotation centrally in the bushing bearing 19. The initial stressing force and therewith the restoring moment of the axle 16 is adjusted by means of a threaded bolt 34 (FIG. 1), which acts through a lever 35 onto the torsion rod. Depending on the initially applied tension to the axle 16, the force which is needed for pivoting the back member is changed, so that the pivot feature can be adjusted to the weight of the user by means of this mechanism.

As can be recognized from FIGS. 2 and 3, the back member 4 is supported by means of two laterally spaced levers 5 arranged on both sides of the seat member 3 and the back member 4. These levers, and also a main control member 24, described in more detail below, are preferably arranged within the seat member and back member areas. However, it is also conceivable to use only one lever arranged centrally in the region of the seat member and the back member.

As is shown in FIG. 3, the two levers 5 which are arranged on the sides of the chair are connected by means of a web or cross brace 23. The web 23 is secured to the seat shell 6 of the chair 1 by plural screws. The web 23 has the bolts 11, 12 thereon, and which are movably arranged in the slots 13, 14 of the levers 5. The web can also be left out and can be replaced with parts of the seat shell.

The L-shaped main control member 24 having legs 24A is provided on the seat construction and extends parallel to and between the two levers 5. The control member 24 is hingedly supported at its lower end, at one end of the leg 24B to the bolt 17 on the seat member 3. The opposite end of control member 24, or the end of the other leg 24A, is connected at its upper end portion to a bolt 25 connected to the back member 4. FIG. 3 shows the bolt 25 being connected to a web 26 which in turn is secured to the back member 4 in the area of the lumbar vertebra. The web 26 can advantageously be a part of the seat shell 6. A pin 27 is secured to the control member 24, which pin extends through a bore in the lever 5. A plate 28 is secured to the lever in the region of the bore, which plate has an elongated slot 29 therein. The plate 28 itself is pivotally arranged or supported for movement about the axis of a bolt 30. The field of traverse of the plate 28 about the axis of the bolt 30 is defined by a pin 31 which is secured to the plate 28 and is received in an arcuate slot 32 in the lever 5. By changing the position of the slot 29 in the plate 28, it is possible to adjust the magnitude of relative movement between the bolt 25 and the back member 4 and thus the lumbar vertebra support, so that same can be adjusted to different body shapes. In place of a plate which can be rotated about the axis of a bolt, it is also possible to use a circular plate which rotates in a correspondingly formed recess.

FIG. 1 shows the two limit positions of the seat construction. In the steep upright position of the back member 4 illustrated in full lines only a smaller lumbar vertebra support is needed, while the need for lumbar vertebra support is substantially greater when the back member is greatly inclined. In the construction of the present invention, the inclined position provides a good and correct lumbar vertebra support. By suitably choosing the hinge points between the lever 5 and the main control member 24 adjacent the seat carrier or on the seat member and in the back region, and also the coupling of the main control member 24 and the lever 5 with one another, it is easily possible to achieve a spot-synchronous adjustment of seat member and back member, so that during a pivoting of the back member 4 with the upper body of the user resting against the back member, no relative movement at all occurs between the back of the chair and the back of the user's body.

Figure 4:
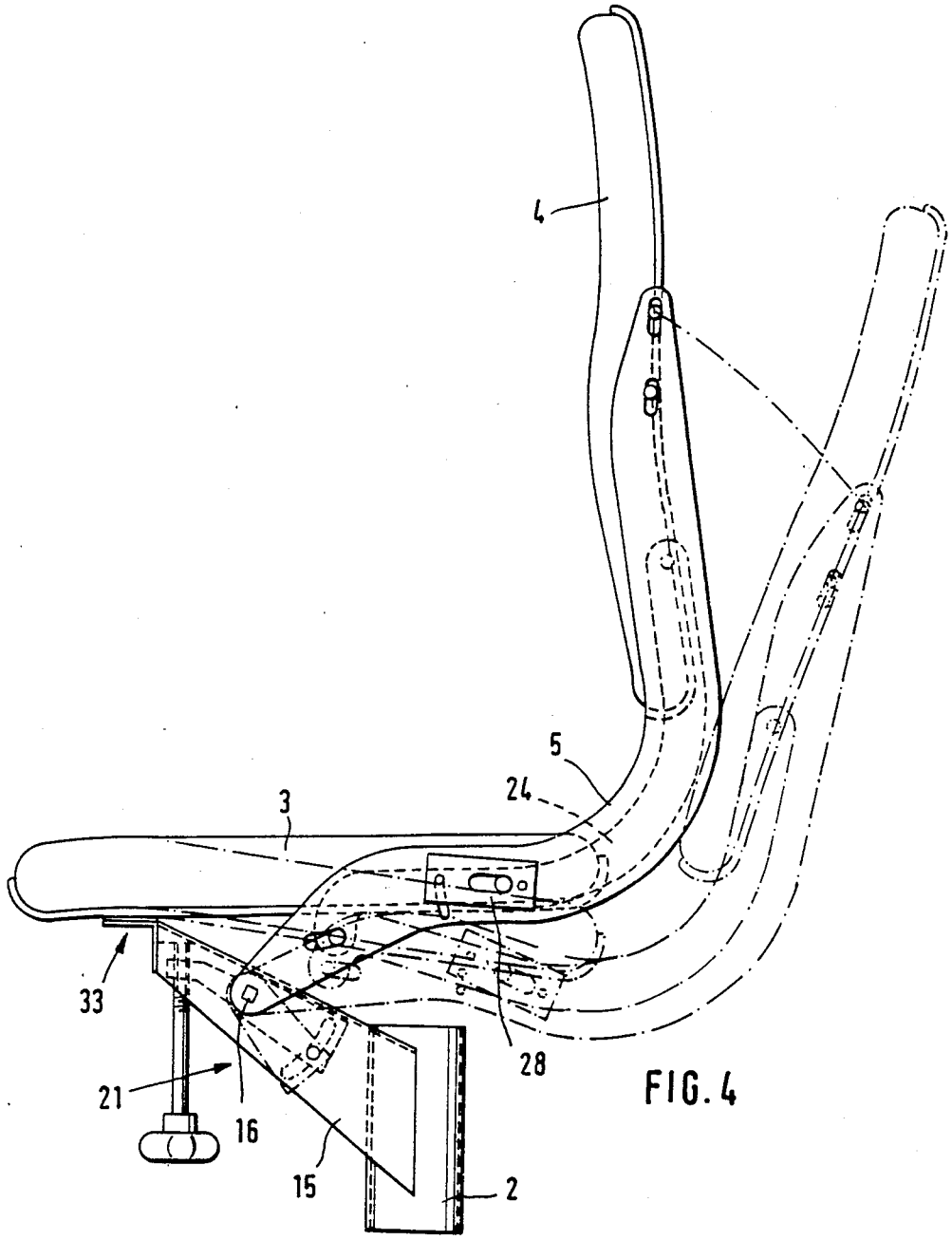
FIG. 4 is a side view of a further exemplary embodiment of an inventively constructed chair.

In the exemplary embodiment which is illustrated in FIG. 4, the same parts are identified by the same reference numerals. The difference with respect to the exemplary embodiment according to FIG. 1 consists only in the seat member 3 and the back member 4 being here not constructed in one piece, but being separate from one another. In this case no elastic seat shell or shell with flexible areas need be provided. The design of the chair and the connection of the main control member and of the lever with one another are the same as has been described with reference to the exemplary embodiment according to FIGS. 1 to 3.

Figure 5:
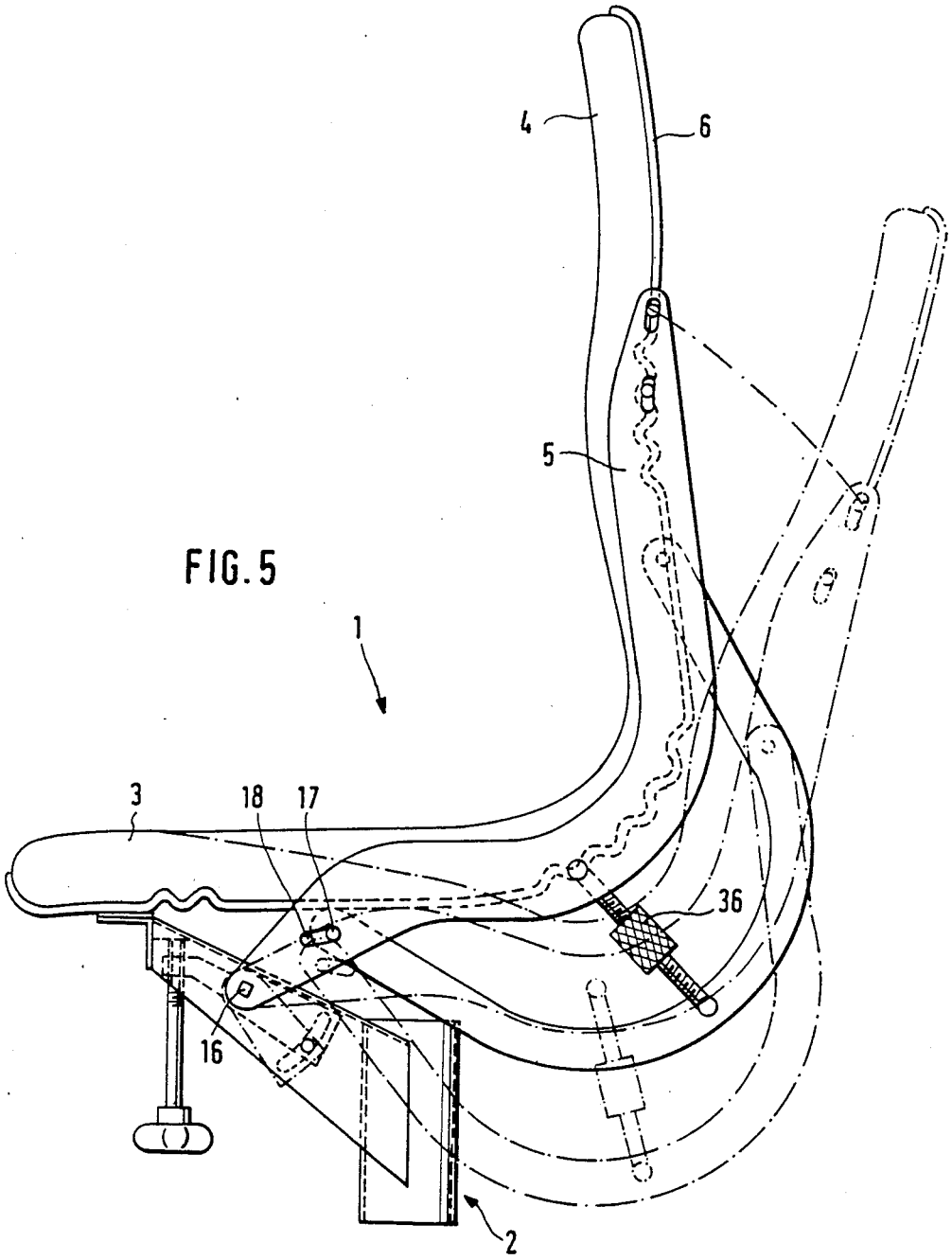
FIG. 5 is a side view of a further embodiment according to the invention.

In the exemplary embodiment which is illustrated in FIG. 5, the same parts are identified by the same reference numerals. The difference with respect to the exemplary embodiments according to FIGS. 1 to 4 consists in the coupling of the lever 5 to the control member 24, not through the elongated slot 29 and pin 27, of the connecting guide link 28 but through an intermediate, additional control member 36, which is preferably adjustable in its length. The intermediate control member 36 is constructed preferably in the form of a tension lock, whereby additional adjustments can be achieved by providing plural and selective hinge points between the control member 36 and the lever 5 and/or the control member 24. One achieves through this the same degree of guiding of the lever 5 with respect to the main control member 24 as was provided with the help of the plate 28 and the slot 29 of the connecting guide link.

In the exemplary embodiments according to FIGS. 1–5, the two levers 5 are laterally spaced on the seat back and are connected with one another through a web 23 secured to the upper region of the seat shell 6. Two laterally lying levers 5 are here not absolutely necessary, but it is also possible to use a lever 5 arranged centrally with respect to the seat shell 6 and in turn, in the upper region of the seat shell, fixedly connected so same. According to a particularly advantageous embodiment, the lever 5 is designed such that it extends over the entire or at least a large region of the seat shell 6. The lever 5 is then in the upper region again connected to the seat shell 6. It forms, however, in contrast to the exemplary embodiments according to FIGS. 1–5 the terminal end of the back of the chair. The leg of the lever extending under the seat member terminates advantageously again in two individual levers which are hingedly connected to the pedestal 2. The designing of the lever 5 as a rear viewing surface does not change anything in its function, which remains the same and as it is described with reference to the exemplary embodiments according to FIGS. 1–5. The advantage of this arrangement consists in the broadened design possibilities for the manufacture of an inventive chair.

The embodiments of the invention in which an exclusive property or privilege is claimed are defined as follows:

1. A chair having a seat member supported pivotally about a swivel point in a region of the front edge of said seat member relative to a seat carrier for said chair, said chair further having a back member connected to at least one lever pivotally supported on said seat carrier and which, at a point spaced from said swivel point, is pivotally connected to said seat member such that upon an inclination of the back member there simultaneously occurs, and at a predetermined relationship, an inclination of the seat member, the improvement comprising a control member hinged at one end to said back member below the point of engagement of said lever therewith, said control member being hinged at its other end of one of (a) said seat carrier at a first axle, and (b) said seat member at said first axle spaced from a second axle, said lever and said control member being hingedly coupled to one another, and further including a connecting element at one of (a) said first axle between said control member and said seat carrier, (b) said second axle between said control member and said seat member, and (c) at the hinged coupling between said control member and said lever, to facilitate a relative movement between said control member and said lever at said hinged coupling point or between said control member and its connecting point to said seat carrier or to said seat member.

2. A chair according to claim 1, wherein said connecting element consists of a plate having an elongated slot therein, in which is movably received a pin.

3. A chair according to claim 2, wherein support means is provided for said plate and thus said slot for facilitating an adjustment in the inclination thereof relative to said lever or to said control member.

4. A chair according to claim 1, wherein said connecting element consists of an intermediate control member.

5. A chair according to claim 4, wherein adjusting means is provided for facilitating an adjustment in the length of said intermediate control.

6. A chair according to claim 1, wherein a connecting link guide is constructed on said lever, into which connecting link guide is received a bolt which is arranged on said seat member.

7. A chair according to claim 6, wherein said control member is hinged to said bolt.

8. A chair according to claim 1, wherein said connecting element including a pin secured to said control member, said pin being received in an elongated slot of a plate which is secured to said lever.

9. A chair according to claim 8, wherein said plate is pivotally secured to said lever.

10. A chair according to claim 1, wherein said seat member and said back member are constructed in one piece and consist of a flexible material and wherein said back member is fixedly secured against rotation with respect to and is longitudinally movable with respect to said lever.

11. A chair according to claim 1, wherein a braking mechanism is provided and is connected to said second axle pivotally connecting said lever to said seat carrier.

12. A chair according to claim 11, wherein said axle is constructed as a torsion spring rod.

13. A chair according to claim 1, wherein said lever at least in the area of said back member extends beyond the width and height of said back member and the chair is flat facing toward the rear.

14. A chair according to claim 13, wherein said lever which is flat in the back part terminates beneath said seat member in two individual levers.

15. A chair having a seat member supported pivotally about a swivel point in a region of the front edge of said seat member relative to a seat carrier for said chair, said chair further having a back member connected to at least one lever pivotally supported at a first axle on said seat carrier which, at a point spaced from said swivel point, is pivotally connected to said seat member such that upon an inclination of the back member there simultaneously occurs, and at a predetermined relationship, an inclination of the seat member, the improvement comprising a control member hinged at one end to said back member below the point of engagement of said lever therewith to adjust the lumbar support of the back member, said control member being hinged at its other end to said seat member at a second axle spaced from said first axle, and a connecting element between said lever and said control member to hingedly couple said lever to said control member to facilitate a relative movement therebetween.

16. A chair according to claim 15, wherein said connecting element comprises an intermediate control member.

17. A chair according to claim 16, wherein said intermediate control member is adjustable.

18. A chair according to claim 15, wherein said connecting element comprises a plate pivotally secured to said lever and a pin secured to said control member and extending through an elongated slot in said plate.

19. A chair according to claim 18, further including a connecting guide link at said second axle for slidably connecting said lever to a bolt on said seat member.

* * * * *

UNITED STATES PATENT AND TRADEMARK OFFICE

CERTIFICATE OF CORRECTION

PATENT NO. : 4,685,733

DATED : August 11, 1987

INVENTOR(S) : Machate et al

It is certified that error appears in the above-identified patent and that said Letters Patent is hereby corrected as shown below:

Claim 1, line 24, "of" should be --to--.

Signed and Sealed this

First Day of December, 1987

*Attest:*

DONALD J. QUIGG

*Attesting Officer*

*Commissioner of Patents and Trademarks*